US008960636B1

(12) United States Patent
Stegmeier, Jr.

(10) Patent No.: US 8,960,636 B1
(45) Date of Patent: Feb. 24, 2015

(54) EDGE FORM SYSTEM FOR FORMING SIMULATED STONE COPING

(71) Applicant: Stegmeier LLC, Arlington, TX (US)

(72) Inventor: William J. Stegmeier, Jr., Henderson, NV (US)

(73) Assignee: Stegmeier, LLC, Arlington, TX (US)

( * ) Notice: Subject to any disclaimer, the term of this patent is extended or adjusted under 35 U.S.C. 154(b) by 0 days.

(21) Appl. No.: 14/042,028

(22) Filed: Sep. 30, 2013

(51) Int. Cl.
*E04G 13/00* (2006.01)
*E04H 4/14* (2006.01)

(52) U.S. Cl.
CPC . *E04G 13/00* (2013.01); *E04H 4/14* (2013.01); *Y10S 249/03* (2013.01)
USPC ..... 249/19; 52/169.7; 249/DIG. 3

(58) Field of Classification Search
CPC ..... E04G 13/00; E04H 4/14
USPC ..... 52/169.7; 249/16, 19, DIG. 3; 4/506, 4/513
See application file for complete search history.

(56) References Cited

U.S. PATENT DOCUMENTS

| | | | | | |
|---|---|---|---|---|---|
| 854,098 | A | * | 5/1907 | Mann | 249/16 |
| 3,348,801 | A | * | 10/1967 | Deason | 249/19 |
| 3,526,070 | A | | 9/1970 | Deason | |
| 3,776,501 | A | * | 12/1973 | Loftin | 249/2 |
| 3,850,403 | A | * | 11/1974 | Stegmeier | 249/19 |
| 3,872,195 | A | * | 3/1975 | Stegmeier | 264/35 |
| 3,904,717 | A | * | 9/1975 | Stegmeier | 264/34 |
| 3,967,422 | A | * | 7/1976 | Stegmeier | 52/169.7 |
| 3,968,191 | A | * | 7/1976 | Stegmeier | 264/34 |
| 3,987,997 | A | * | 10/1976 | Stegmeier | 249/207 |
| 4,048,270 | A | * | 9/1977 | Stegmeier | 264/34 |
| 4,136,850 | A | * | 1/1979 | Grosch | 249/19 |
| 4,245,810 | A | * | 1/1981 | Green | 249/19 |
| 4,387,877 | A | * | 6/1983 | Deason | 249/9 |
| 4,395,014 | A | * | 7/1983 | Deason | 249/9 |
| 4,457,119 | A | | 7/1984 | Dahowski | |
| 4,574,017 | A | | 3/1986 | Stegmeier | |
| D284,971 | S | | 8/1986 | Deason | |
| 4,735,395 | A | * | 4/1988 | Dahowski | 249/10 |
| 5,680,730 | A | | 10/1997 | Epple | |
| 5,695,586 | A | | 12/1997 | Stegmeier | |
| 6,189,278 | B1 | * | 2/2001 | Stegmeier | 52/396.02 |
| 6,725,469 | B2 | | 4/2004 | Coates | |
| 7,861,471 | B2 | | 1/2011 | Smith | |
| 8,074,958 | B1 | * | 12/2011 | Hoy | 249/19 |
| 8,458,973 | B1 | * | 6/2013 | Powers, Jr. | 52/293.2 |

* cited by examiner

*Primary Examiner* — Michael Safavi
(74) *Attorney, Agent, or Firm* — Eric Karich

(57) ABSTRACT

An edge form system has a molded liner and a form board. The molded liner has a textured imprinting on the inner surface for forming a simulated stone coping and a first interlocking element. The form board has a base for mounting the form board on a vertical structure, a coping support wall, a liner receiver, and a second interlocking element for interlocking with the first interlocking element.

15 Claims, 5 Drawing Sheets

EDGE FORM SYSTEM FOR FORMING SIMULATED STONE COPING

BACKGROUND OF THE INVENTION

1. Field of the Invention

This invention relates generally to forms for forming a coping, and more particularly to an edge form system for forming simulated stone coping.

2. Description of Related Art

There are several examples of polystyrene forms that are used to form the front face of a coping. Examples of such prior art forms include are shown in Deason (U.S. Pat. No. 3,526,070, and U.S. D284971), as well as to Stegmeier (U.S. Pat. No. 4,574,017 and U.S. Pat. No. 5,695,586). Various other references include the following: Coates, U.S. Pat. No. 6,725,469; Epple, U.S. Pat. No. 5,680,730; Smith, U.S. Pat. No. 7,861,471; and Dahowski, U.S. Pat. No. 4,457,119. The above-described references are hereby incorporated by reference in full.

The prior art teaches form boards that are mounted on an edge of a pool for forming a shaped coping when the deck is poured. However, the prior art does not teach a form board that receives a liner that is molded to impart a realistic stone texturing, or other form of texturing, that cannot be achieved with prior art forms. The prior art also does not teach an interlocking mechanism for interlocking the molded liner with the form board, so that the liner is held securely in place without the use of tapes or adhesives. The present invention fulfills these needs and provides further advantages as described in the following summary.

SUMMARY OF THE INVENTION

The present invention teaches certain benefits in construction and use which give rise to the objectives described below.

The present invention provides an edge form system for forming a simulated stone coping above a vertical structure. The edge form system has a molded liner and a form board. The molded liner has an inner surface and an outer surface, each connected by a top edge and a bottom edge, a textured imprinting on the inner surface for forming the simulated stone coping, and a first interlocking element formed in the bottom edge. The form board has a base for mounting the form board on the vertical structure, a coping support wall extending upwardly from the base, the coping support wall having a support surface. The base and the support surface of the support wall together form a liner receiver shaped to receive the molded liner. There is a second interlocking element in the base and/or the coping support wall shaped to interlock with the first interlocking element of the molded liner.

A primary objective of the present invention is to provide an edge form system having advantages not taught by the prior art.

Another objective is to provide an edge form system for quickly and easily forming realistic simulated stone coping.

Another objective is to provide an edge form system that includes a molded liner that includes interlocking elements for locking the molded liner against the form board during use, without the use of tape or adhesives.

A further objective is to provide an edge form system that includes molded liners that may be reused.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an edge form system 10 for forming a simulated stone coping 18 above a vertical structure 12 such as a bond beam of a swimming pool.

Figure 1:
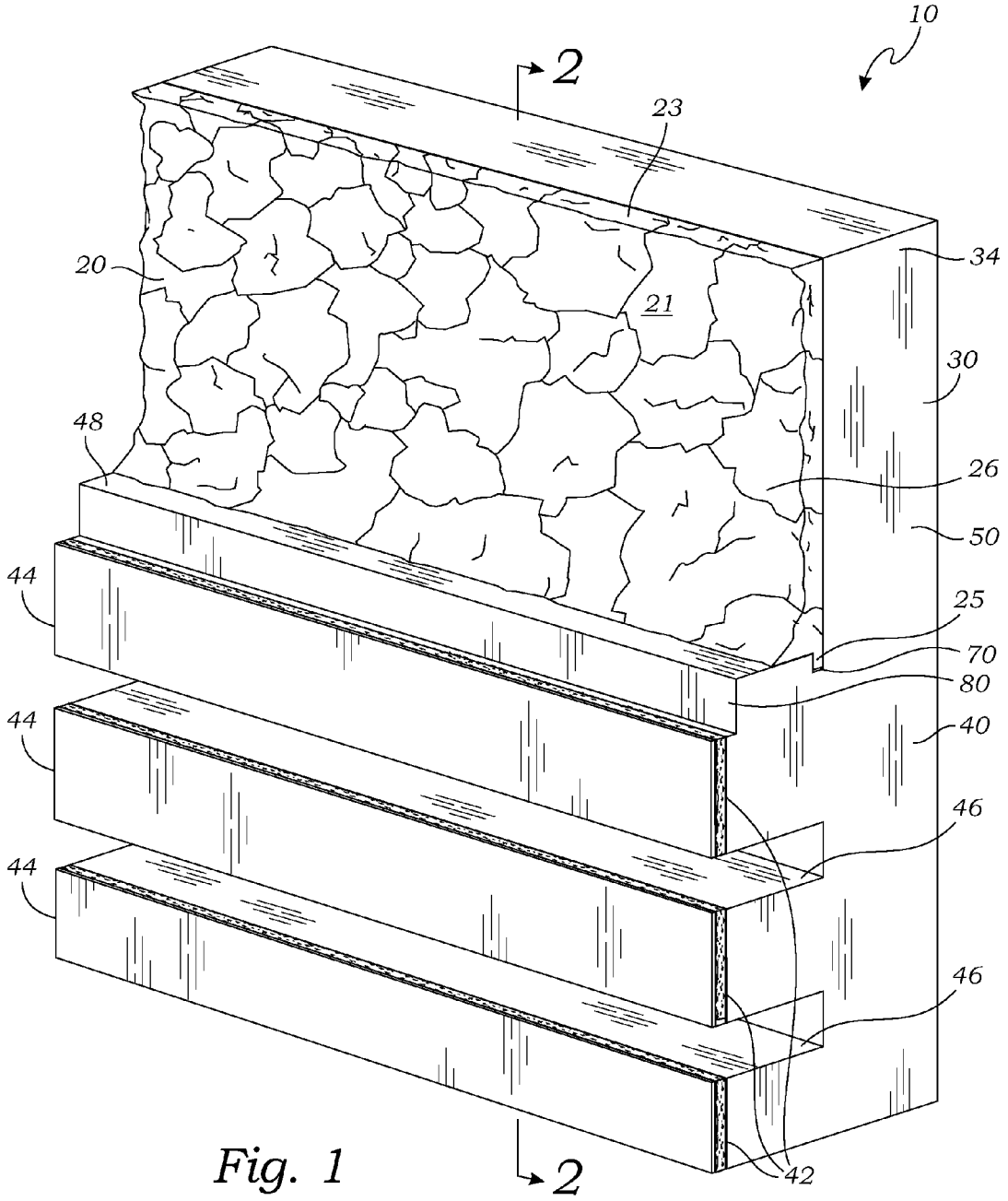
FIG. 1 is a front perspective view of one embodiment of an edge form system, illustrating one embodiment of a molded liner and a form board.
Figure 2:
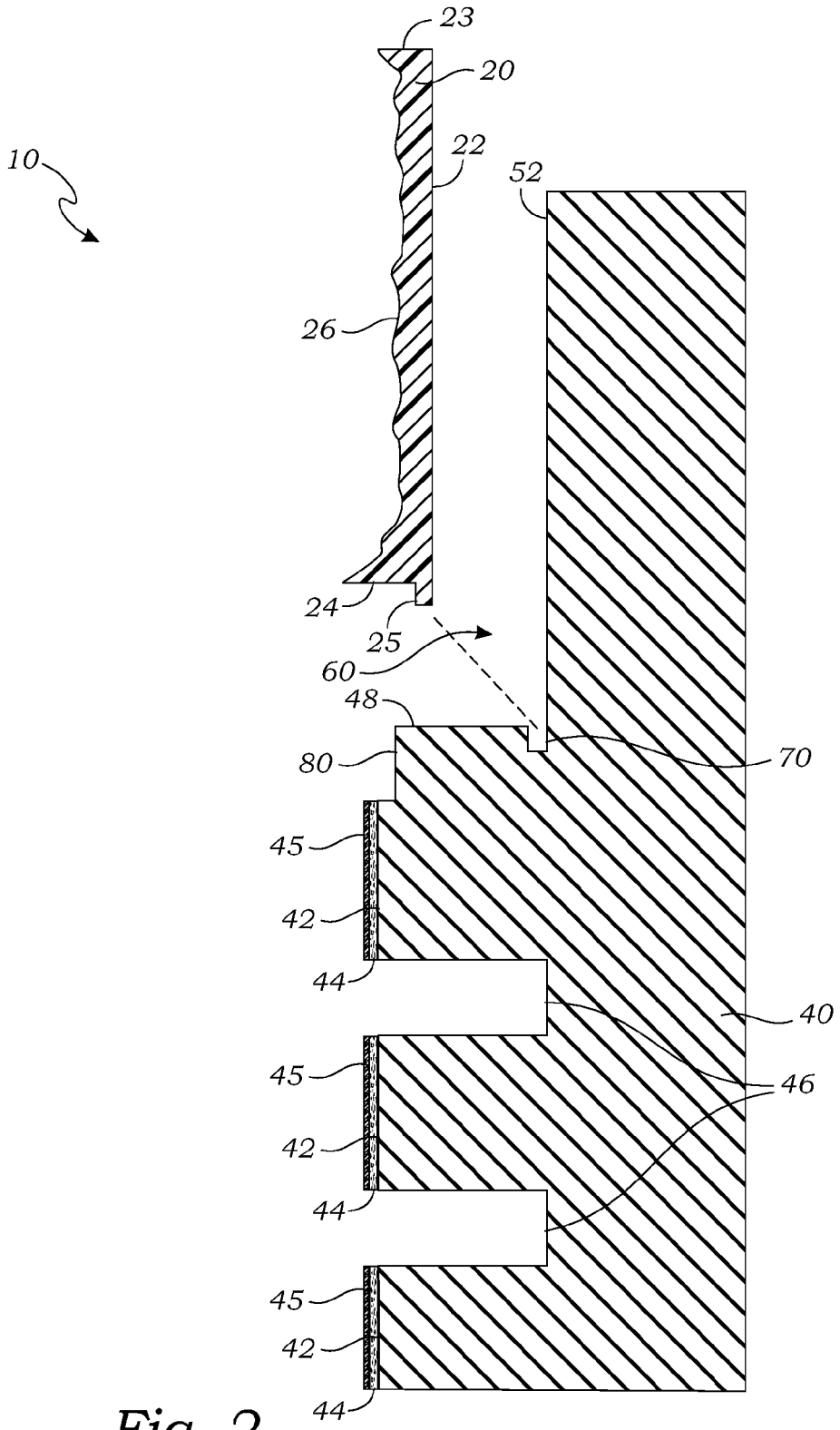
FIG. 2 is an exploded side elevational view thereof.

FIG. 1 is a front perspective view of one embodiment of the edge form system 10, illustrating one embodiment of a molded liner 20 and a form board 30. FIG. 2 is an exploded side elevational view thereof. As illustrated in FIGS. 1-2, the molded liner 20 has an inner surface 21, an outer surface 22, a top edge 23, and a bottom edge 24. The inner surface 21 includes a textured imprinting 26 that is molded or otherwise formed so that when concrete is poured adjacent to it, the concrete will retain the texturing so that it resembles stone or some other desirable surface shape and texture. The textured imprinting 26 may be shaped for imparting a rough stone-like appearance to the concrete poured once it has dried. The style of texture may be of any sort, including rough stone, brick and mortar, or any other pattern, and may include any form of patterns, words, images, etc.

In this embodiment, the outer surface 22, opposite the inner surface 21, abuts the form board 30 in such a way that the molded liner 20 is held in place during the pouring and curing of the concrete. The top edge 23 may be generally aligned with the top of the form board 30, though this is not necessary, and in this embodiment the top edge 23 extends outwardly to impart a gentle curve to the top edge of the simulated stone coping 18 (shown in FIGS. 3 and 4).

In the embodiment of FIGS. 1 and 2, the form board 30 has a base 40 for mounting the form board on the vertical structure 12, and a coping support wall 50 extending upwardly from the base 40. The base 40 includes a top surface 48, a support surface 52, and a liner receiver 60 which is the space formed by the top surface 48 of the base 40 and the support surface 52 of the coping support wall 50, and is where the molded liner 20 is seated. When seated in the liner receiver 60, the textured imprinting 26 of the molded liner 20 is exposed, and the outer surface 22 abuts the support surface 52, with the bottom edge 24 of the molded liner 20 resting on the form board 30 which supports the molded liner 20.

In the embodiment of FIGS. 1 and 2, the molded liner 20 further includes a first interlocking element 25 for locking the molded liner 20 against the form board 30. The first interlocking element 25 may be located at the bottom edge 24 of the molded liner 20 and may be used to properly seat the molded liner 20 within the form board 30. In one embodiment, the first interlocking element 25 is a ridge that extends lengthwise along the bottom edge 24 of the molded liner 20.

Also as shown in FIGS. 1-2, the form board 30 includes a second interlocking element 70 that is adapted to interlock with the first interlocking element 25. In this embodiment, the second interlocking element 70 may be a groove shaped to lockingly engage the ridge 25 to hold the molded liner 20 in place. As shown in FIGS. 1 and 2, when properly seated, the shapes of the ridge 25 and the groove 70 prevent movement of the molded liner 20 while positioned in the liner receiver 60.

In another embodiment, the first interlocking element 25 may include a plurality of posts or other forms of interlocking elements, along with a corresponding plurality receivers that form the second interlocking element 70 on the top surface 48 shaped to receive and lockingly engage the plurality of the first interlocking elements 25. The elements may be reversed, and/or replaced with any other forms of structure or structures that interlock in a similar manner for holding the liner 20 in place. Other forms of interlocking mechanisms may be posts and holes, triangular wedges and triangular-shaped receivers, locking pins, elastic protrusions from the molded liner 20 which may be pried from the receiver liner receiver 60 on the form board 30, or others known to those skilled in the art, all being equivalent and within the scope of the present invention. In some embodiments, the liner 20 is held in place without the use of tape or adhesives. Other methods of holding the molded liner 20 in place on the form board 30 may also be used, including the use of an adhesive, fasteners, ties, locks, clamps, etc. known to those skilled in the art. Also, any number, orientation, and combination thereof, of the first interlocking elements 25 and the corresponding second interlocking elements 70 may be used, such variations considered equivalent and within the scope of the present invention.

The coping support wall 50 is a portion of the form board 30 which may extend upwardly from the base 40 and acts as a support structure for keeping the molded liner 20 in the proper position. Also, the coping support wall 50 should be of sufficient thickness (or width) to support the pressure due to the concrete prior to setting. Such thickness may be determined by those skilled in the art and will vary according to the material of which the form board 30 is made and the height of the molded liner 20 to be supported when concrete is poured. The support surface 52 of the coping support wall 50 abuts the outer surface 22 of the molded liner 20. The support surface 52 and the outer surface 22 may be generally smooth, for making solid contact and a secure hold on the molded liner 20. In one embodiment, the outer surface 22 and the support surface 52 are planar, but other embodiments may have alternate shapes, including curved, ridged, segmented, etc.

Figure 3:
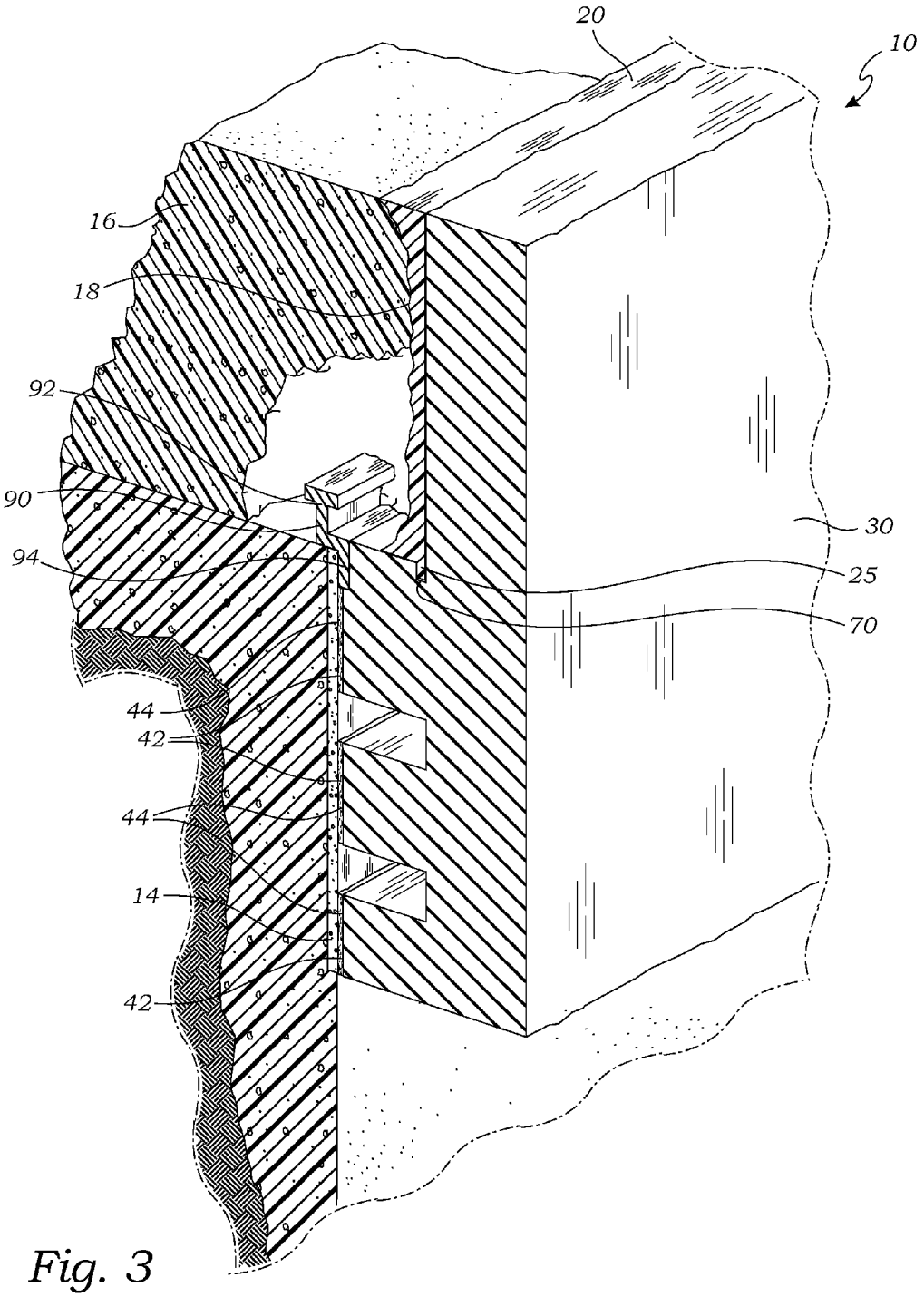
FIG. 3 is a rear perspective view of the edge form system operatively installed on a bond beam of a swimming pool for forming a simulated stone coping on top of the bond beam of the swimming pool.

In this embodiment, the base 40 may include one or more mounting surfaces 42 for mounting the base 40 to the vertical structure 12 (shown in FIG. 3). The mounting surfaces 42 may be separated by one or more lateral kerfs 46. The mounting surfaces 42 may include an adhesive layer 44 for mounting the base 40 to the vertical structure 12. Any kind of bonding agent known to those skilled in the art may be used, including epoxy, glue, or other tacky substance which may form a strong, but preferably removable, bond between the form board 30 and the vertical structure 12. Additionally, peel-removable tape 45 (e.g., wax paper or other removable layer) may be used to cover the adhesive layer 44 to protect it, and removed prior to mounting the form board 30 on the vertical structure 12.

In the present embodiment, three of the adhesive layers 44 are included on three of the mounting surfaces 42, rather than the usual two. The inclusion of a third mounting surface 42 provides additional adhesive strength so that it is possible to mount the form board 30 without the use of tie-wires. It is preferred to avoid the use of tie wires when using the molded liner 20, because the molded liner 20 interferes with the positioning of the tie wire therethrough. This is an improvement over the prior art, which had previously considered the inclusion of tie wires to be important to properly supporting the form board 30, so that the form board 30 was able to support the weight of the concrete.

The lateral kerfs 46 are slots where material has been removed from the base 40 for the purpose of adding flexibility to the form board 30, so that the form board 30 can fit around curves in the shape of the pool or other structure. The number of the lateral kerfs 46 and the mounting surfaces 42 are variable and depend on the strength needed to hold the base 40 in place on the vertical structure 12 and also the structural limitations of the vertical structure 12, for instance if there was an obstruction that limited the overall height of the combination of the mounting surfaces 42 and the lateral kerfs 46. In one embodiment, there may be three of the mounting surfaces 42, with two of the lateral kerfs 46 separating them. In other embodiments, there may be more or fewer of the mounting surfaces 42 and the lateral kerfs 46. The number, placement, and shape or depth of the lateral kerfs 46 may be determined by those skilled in the art and should be considered equivalent and within the scope of the present invention.

Also, as shown in FIGS. 1-2, the form board 30 may also include a receiving recess 80 for receiving an elongate protective strip 90 (shown in FIG. 3). In one embodiment, the receiving recess 80 may be formed at the intersection of the uppermost of the mounting surfaces 42 and the top surface 48. The receiving recess 80 is discussed in greater detail below. In other embodiments, there may be no need for the elongate protective strip 90. In this case, the form board 30 may not have the receiving recess 80, but may be as described above in all other respects.

In one embodiment, the height of the mounting surfaces 42 may be about 1.9 cm. (0.75 inches), and the height of the lateral kerfs 46 may be about 1.3 cm. (0.5 inches). In another embodiment the height of the mounting surfaces 42 may be between 4.0 cm. (1.6 inches) and 1.0 cm. (0.4 inches) and the height of the lateral kerfs 46 may be between 3.0 cm (1.18 inches) and 0.5 cm. (0.2 inches). In another embodiment the height of the mounting surfaces 42 may be between 10.0 cm. (4 inches) and 5.0 cm. (2 inches) and the height of the lateral kerfs 46 may be between 7.0 cm (2.75 inches) and 3.0 cm. (1.18 inches). The term "about" as used in describing dimensions or ranges indicates an uncertainty of 10%. Other sizes of the lateral kerfs 46 and the mounting surfaces 42 may be used by those skilled in the art, depending the support needed, the number and placement of the lateral kerfs 46 and the mounting surfaces 42, etc. and should be considered equivalent and within the scope of the present invention.

FIG. 3 is a rear perspective view of the edge form system 10 operatively installed on a bond beam of a swimming pool forming the simulated stone coping 18 of the swimming pool. Here we discuss one possible method of use of the present embodiment of the edge form system 10. Other methods of use known to those skilled in the art may also be employed and considered equivalent to the description below. As shown in FIG. 3, the swimming pool forms the vertical structure 12, which also includes a tile layer 14.

As illustrated in FIG. 3, the method of assembly of the edge form system 10 begins with mounting the form boards 30 on the vertical structure 12, in this case completely around the pool. In this embodiment, the form boards 30 are mounted via the adhesive layers 44 on each of the mounting surfaces 42. The peel-removable tape 45 (shown in FIG. 2) is removed from the mounting surfaces 42 to expose the adhesive layers 44 on each of the mounting surfaces 42, and this is then used to mount the form board 30 on the vertical structure 12. Other mounting mechanisms or systems may also be used, as discussed in greater detail below, and any alternative methods or systems should be considered within the scope of the present invention.

Once the form boards 30 have been installed, the molded liner 20 is placed within the liner receiver 60 of the form boards 30, as illustrated in FIGS. 1-3. The first interlocking element 25 interlocks with the second interlocking element 70, to hold the molded liner 20 in place on the form board 30. Release agents may be added to the molded liner 20 to enable the later removal of the molded liner 20, and it is helpful if the interlocking elements 25 and 70 enable interlocking without the use of any adhesives, tape, etc.

In this embodiment, an elongate protective strip 90 may be positioned in the receiving recess 80. The elongate protective strip 90 may include an anchor 92 and a protective wall 94 that extends downwardly from the anchor 92. The anchor 92 of the elongate protective strip 90 is captured by the poured concrete, such that the protective wall 94 extends downwardly to cover the crack between the coping and the bond beam of the pool, and to also cover a top edge of the tile layer 14. Such tile layer formations are very common in forming attractive edging in a swimming pool, Jacuzzi, decorative pond, or other similar constructions, where the edge form system 10 is intended for use.

Concrete is then poured into the space defined on one side by the molded liner 20, forming a concrete fill 16 that forms the coping of the pool or other structure. When the concrete fill 16 cures, the molded liner 20 provides the texture of stone (or other desirable texture) to the surface of the concrete. For purposes of this application, the term "concrete" is hereby broadly defined to include not only concrete but also any form of plastic, resin, composite, or any other form of equivalent material or any generally pourable and malleable material wherein after appropriate curing, drying, or setting will form a rigid structure that retains the desired molded pattern or texture.

After the concrete fill 16 has cured to the satisfaction of the skilled user (though it may not be fully hardened should additional sculpting need to occur) the form board 30 is stripped from the vertical structure 12, breaking the contact at the adhesive layer 44, and the form board 30 may be removed for disposal (not shown). Afterwards, the molded liner 20 may be removed.

Figure 4:
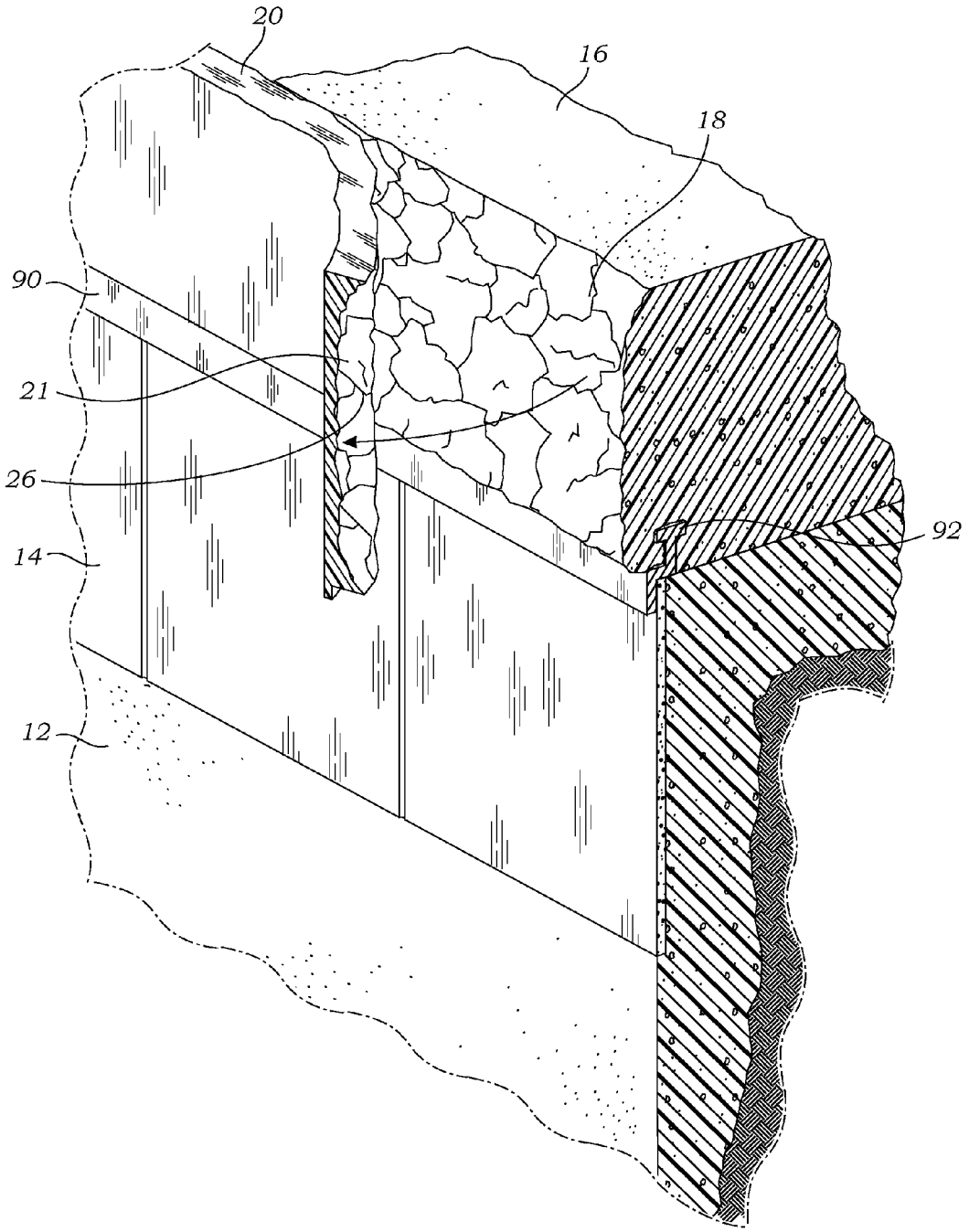
FIG. 4 is a perspective view of the molded liner being peeled from the simulated stone coping once it has cured.

FIG. 4 is a perspective view of the molded liner 20 being peeled from the simulated stone coping 18 once it has cured. As shown in FIG. 4, the textured imprinting 26 on the inner surface 21 of the molded liner 20 leaves its impression on the concrete fill 16, which in this case is shown as a rough-hewn stone appearance with rounded corners, thus forming the simulated stone coping 18. Also as shown in FIG. 4, the anchor 92 of the elongate protective strip 90 is captured by the concrete fill, so that the elongate protective strip 90 covers the crack between the coping and the bond beam of the pool.

Figure 5:
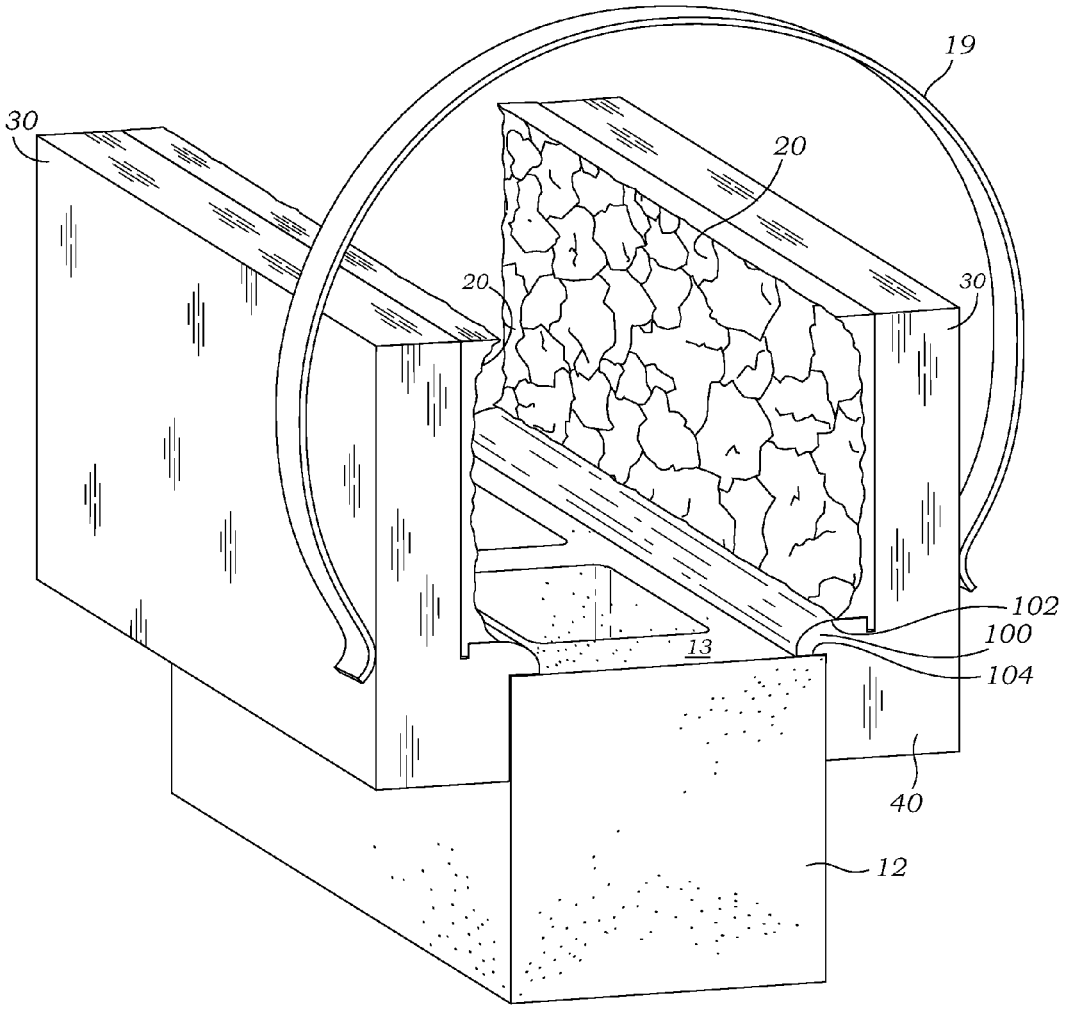
FIG. 5 is a perspective view of another embodiment of the edge form system, illustrating the edge form system being held in place on a vertical structure by a spring clamp.

FIG. 5 is a perspective view of another embodiment of the edge form system 10, illustrating the edge form system 10 being held in place on the vertical structure 12 by a spring clamp 19. In this embodiment, a pair of the form boards 30 may be clamped onto the vertical structure 12, shown as a concrete block, with the spring clamp 19. In this embodiment, each of the form boards 30 has the molded liner 20 in place in the liner receiver 60. Once clamped, the two edge form systems 10 create a space for pouring the concrete fill 16 (shown in FIGS. 3 & 4). In this embodiment, the base 40 includes a lip 100 which may extend past the bottom edge 24 of the molded liner 20. The lip 100 has a top lip surface 102 and a bottom lip surface 104. The lip 100 may extend outwardly over a top surface 13 of the vertical structure 12 such that the bottom lip surface 104 abuts the top surface 13 of the vertical structure 12. This serves to prevent vertical slippage during setup, keep the edge form system 10 in place during pouring of the concrete fill 16, and throughout the curing process. The top lip surface 102, as shown in FIG. 5, has a generally rounded shape, though other shapes are possible, such as rectangular, triangular, or any other shape, as determined by those skilled in the art. The bottom lip surface 104 may be generally planar, for making good contact with the top surface 13, but texturing or other irregular shapes may also be chosen according to those skilled in the art. As shown in this embodiment, no adhesive layer is present, though in other embodiments an adhesive layer may be present in addition to the spring clamp 19. Similarly, no lateral kerfs are included in this embodiment, though in other embodiments those may be present as well.

One method of using the present embodiment for forming a simulated stone coping 18, as illustrated in FIG. 5, may be to begin by mounting the pair of edge form systems 10 on the vertical structure 12 such that the lip 100 holds them in place. The spring clamp 19 may them be applied to the form boards 30 to clamp them together against the vertical structure 12.

The molded liners 20 are then placed within the liner receiver 60 of the form board 30 for each of the pair of edge form systems 10. The concrete fill 16 is then poured and allowed to cure. When ready, the spring clamp 19 may be removed and the two edge form systems 10 are pulled away, leaving the simulated stone coping 18. While FIG. 5 illustrates one embodiment of the edge form system 10, those skilled in the art may devise alternative embodiments, and these alternative or equivalent are considered within the scope of the present invention.

Furthermore, while this application discusses the specific use of the system 10 for use in the construction of a swimming pool, it may be likewise used to form a coping on any similar structures. The term "vertical structure" is hereby defined to include any part of the pool structure (e.g., wall, tile, etc.), as well as similar structures (e.g., a concrete countertop, decorative tops to walls or other structures, etc.).

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. An edge form system for forming a simulated stone coping above a vertical structure, the edge form system comprising:

a molded liner comprising:

an inner surface and an outer surface connected by a top edge and a bottom edge;

a textured imprinting on the inner surface for forming the simulated stone coping; and a first interlocking element formed in the bottom edge; and a form board comprising:

a base for mounting the form board on the vertical structure;

a coping support wall extending upwardly from the base, the coping support wall having a support surface, the base and the support surface of the support wall together forming a liner receiver shaped to receive the molded liner; and a second interlocking element in the base and/or the coping support wall shaped to interlock with the first interlocking element of the molded liner.

2. The edge form system of claim 1, wherein the base includes a plurality of mounting surfaces, each of the mounting surfaces being separated from adjacent mounting surfaces by a lateral kerf, each of the mounting surfaces having an adhesive layer for bonding the base to the vertical structure.

3. The edge form system of claim 1, wherein the base includes three mounting surfaces, each having a height of about 1.9 cm. (0.75 inches), and each of the mounting surfaces being separated from adjacent mounting surfaces by a lateral kerf that is about 1.3 cm. (0.50 inches) high.

4. The edge form system of claim 1, wherein the base includes a top surface that is adjacent to and generally perpendicular to the support surface.

5. The edge form system of claim 4, further comprising a tile strip receiving recess located between the top surface of the base and the mounting surfaces of the base.

6. The edge form system of claim 5, further comprising an elongate tile protective strip having an anchor that extends upwardly from the form board, and a protective wall that extends downwardly in the receiving recess.

7. The edge form system of claim 1, wherein the first interlocking element is a ridge extending outwardly from the molded liner, and wherein the second interlocking element is a groove formed in the form board.

8. The edge form system of claim 7, wherein the groove extends into the base adjacent the support surface of the coping support wall.

9. The edge form system of claim 1, wherein the outer surface of the molded liner and the support surface of the form board are planar.

10. The edge form system of claim 1, wherein the molded liner is flexible for allowing the molded liner to be peeled from the simulated stone coping after use.

11. The edge form system of claim 1, the molded liner further comprising a plurality of first interlocking elements and the form board further comprising a plurality of second interlocking elements.

12. The edge form system of claim 1, wherein the base includes a lip having a top lip surface and a bottom lip surface, which extends outwardly over a top surface of the vertical structure such that the bottom lip surface abuts the top surface of the vertical structure.

13. The edge form system of claim 1, wherein the first interlocking element is connected to the outer surface, and the second interlocking element is connected to the support surface.

14. The edge form system of claim 13, wherein the first interlocking element and the second interlocking element are substantially vertical in orientation.

15. An edge form system for forming simulated stone coping above a vertical structure, the edge form system comprising:

a molded liner comprising:

an inner surface and an outer surface connected by a top edge and a bottom edge;

a textured imprinting on the inner surface for forming the simulated stone coping; and a ridge extending from the bottom edge; and a form board comprising:

a base for mounting the form board on the vertical structure;

a coping support wall extending upwardly from the base, the coping support wall having a support surface, the base and the support surface of the support wall together forming a liner receiver shaped to receive the molded liner; and a receiving structure in the base and/or the coping support wall shaped to receive and frictionally engage the ridge of the molded liner for anchoring the molded liner in the liner receiver of the form board.

* * * * *